United States Patent [19]

Marshik

[11] Patent Number: 4,610,108

[45] Date of Patent: Sep. 9, 1986

[54] BALANCE SPRING LOCKING SLIDE BLOCK FOR TILT-OUT WINDOWS

[76] Inventor: Gary J. Marshik, Box 353, Canton, S. Dak. 57013

[21] Appl. No.: 684,073

[22] Filed: Dec. 20, 1984

[51] Int. Cl.[4] ..... E05D 15/22
[52] U.S. Cl. ..... 49/181; 49/453
[58] Field of Search ..... 49/181, 453, 454, 455

[56] References Cited

U.S. PATENT DOCUMENTS

| | | | |
|---|---|---|---|
| 3,055,062 | 9/1962 | Peters et al. . | |
| 3,195,174 | 7/1965 | Nobes . | |
| 3,434,236 | 3/1969 | Weidner et al. | 49/181 X |
| 3,524,282 | 8/1970 | Kraft et al. . | |
| 3,676,956 | 7/1972 | Taylor et al. . | |
| 3,797,168 | 3/1974 | Trout . | |
| 3,842,540 | 10/1974 | Anderson . | |
| 3,844,066 | 10/1974 | Nobes . | |
| 4,079,549 | 3/1978 | Wood . | |
| 4,364,199 | 12/1982 | Johnson et al. . | |
| 4,452,012 | 6/1984 | Deal | 49/181 |

OTHER PUBLICATIONS

Caldwell Aluma-Tilt Balance by Caldwell Manufacturing Co., P.O. Box 444, Rochester, New York 14602.
Jim Walter Window Components, Series 9000 Balance/Weatherstrip for Full-Tilt Windows by J. W. W. C. 1009 Algonquin/Sioux Falls, South Dakota.

*Primary Examiner*—Kenneth Downey
*Attorney, Agent, or Firm*—Vidas & Arrett

[57] ABSTRACT

The invention relates to tilt-out window assemblies in which a window sash may be rotated from its normal vertical position causing a slide block connected to a spring balance assembly to be locked into place to prevent release of the spring balance assembly on tilting or removal of the window sash from the window frame. The slide block rides in the jamb channel in which the window sash normally slides up and down and incorporates a rotatable locking cam. The locking cam is rotated on tilting of the window sash so as to force a set of locking members against the sides of the window frame jamb channel to engage the block into a fixed position in the channel. The window sash is operatively connected to the locking cam to provide rotation thereof to lock the slidable block. The window sash may be removed from the frame and from engagement with the locking cam if desired.

5 Claims, 7 Drawing Figures

BALANCE SPRING LOCKING SLIDE BLOCK FOR TILT-OUT WINDOWS

BACKGROUND

This invention relates generally to tilt-out windows, both of the take-out and non-take-out type. It is particularly directed to those types which include metal (aluminum) or vinyl sash guides or jamb channels, most particularly the vinyl type.

Rigid plastic extrusions are being used more frequently as side jamb channels in windows of this type. Vinyl is typically used and is preferred for this invention. Various types are well known.

Generally, windows of this type have been in use for some time. They are typically provided in a pivoted or tilt-out double-hung version. Their convenience for washing the outside of the window or for replacing broken panes has made them very popular.

The counterbalance system for holding such window sashes in an open or closed position has progressed from a counterweight to a spring balance assembly, various types of which are well known. The spring balance assembly is enclosed in the side jamb channels or weather strips on each side of the window sash.

One of the problems with the pivoted or tilt-out windows has been the retention of the end of the counterbalance spring assembly which is attached to or removably secured to the window sash itself. Since the window sash can be tilted out of the frame, or is even completely removable in some designs, it is desirable that the sash not be vertically movable when tilted out or when its full weight is not available to offset the pull of the spring balance assembly. It is desirable when tilting the window or removing it that the spring balance assembly be retained in a fixed position within the jamb channel by a positive locking arrangement and that the spring assembly not be allowed to move or to snap upwardly in an uncontrolled manner as, after a few such releases, the assembly may be deformed and its effectiveness reduced.

Many types of locking mechanisms have heretofore been available. Reference may be had to U.S. Pat. Nos. 4,364,199; 3,797,168; 3,844,066; 4,079,549; 3,676,956; 3,055,062; 3,842,540; 3,524,282; 3,195,174; and advertising articles entitled Caldwell Aluma-Tilt Balance by Caldwell Manufacturing Co., P.O. Box 444, Rochester, N.Y. 14602 and Jim Walter Window Components, Series 9000 Balance/Weatherstrip for Full-Tilt Windows by J.W.W.C. 1009 Algonquin/Sioux Falls, S.D. 57104.

A still further type of locking mechanism comprises a hook which has a sharp point to embed into one of the walls of the side jamb channel. However, this type of locking engagement is subject to being dislodged when downward pressure is applied.

SUMMARY OF THE INVENTION

The invention is directed to a novel locking mechanism for spring-balance tilt-out windows. The locking mechanism comprises a slide block shaped to ride up and down in the side jamb channels and which incorporates a pair of oppositely disposed extendable locking members which are operated by a rotatable cam member operatively connected to the window sash so as to rotate on window tilt-out to extend the locking members outwardly of the block for engagement into the walls of the jamb channel to lock the block in a fixed position therein. Since the spring balance assembly is connected to the block it is maintained in position until the window is rotated back into its normal vertical position whereby the cam releases the block for movement.

DESCRIPTION OF PREFERRED EMBODIMENT

Figure 1:
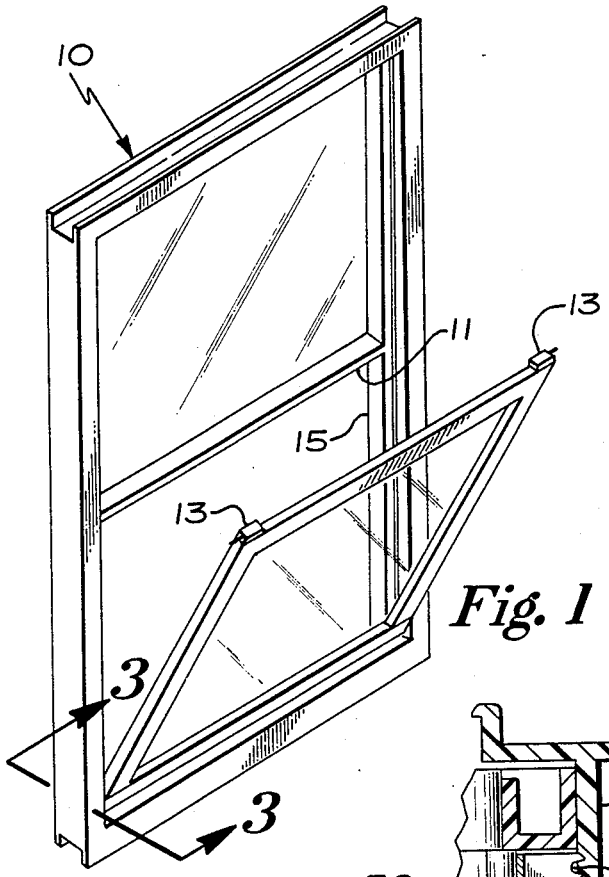
FIG. 1 is a perspective view of a double-hung window with the lower window sash in a tilted position.

FIG. 1 shows the environment of the present invention, omitting details of the frame, and the spring balancing mechanism, as well as other structural details which are considered conventional. As for balancing mechanisms, which may be used with the present invention, any conventional balancing mechanism will serve the purpose. Since windows are symmetrical in construction, it is believed necessary to describe only one-half thereof in detail. Consequently, only the details of one side of the window and one jamb track thereof are shown.

The improved locking block or slide member of the invention is shown in connection with a double-hung tilt-out type window in FIG. 1. The frame of the window, indicated at 10 incorporates sashes 11 and 12 which are slidably mounted in jamb channels one of which is generally indicated at 15. Such jamb channels are ordinarily parallel to one another in the frame and the individual sashes slide vertically therein between closed and open positions. Conventionally, each sash has a balance spring assembly (not shown) associated therewith on either side of the sash and carried in the respective jamb channel in which the sash slides. As shown in FIG. 1, the lower sash 12 is shown in a tilted position. With such tilt of the sash, the improved balance spring locking block or slide member operates to lock itself in a fixed position by embedding the serrated ends of the spring member into the jamb channels, one to each side of the sash, so as to maintain the balance spring assembly in a fixed position during removal of the sash from the jamb channels for cleaning, replacement and the like. The spring balance assembly is thus maintained in a fixed position so that it will not move in the jamb channel and the sash may be readily replaced, rotated into the vertical position to unlock the locking block or slide member so as to allow vertical movement of the window in the jamb channels very readily.

Figure 7:
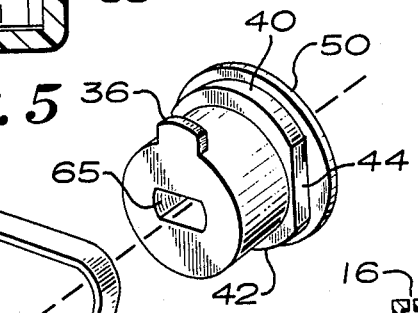
FIG. 7 is a cross-sectional view of a typical vinyl jamb liner or channel.

A finger operated sliding guide or similar arrangement indicated at 13 holds the window in position in the normal operating condition by engaging the track 16 (best seen in FIG. 7), as is conventional.

Figure 2:
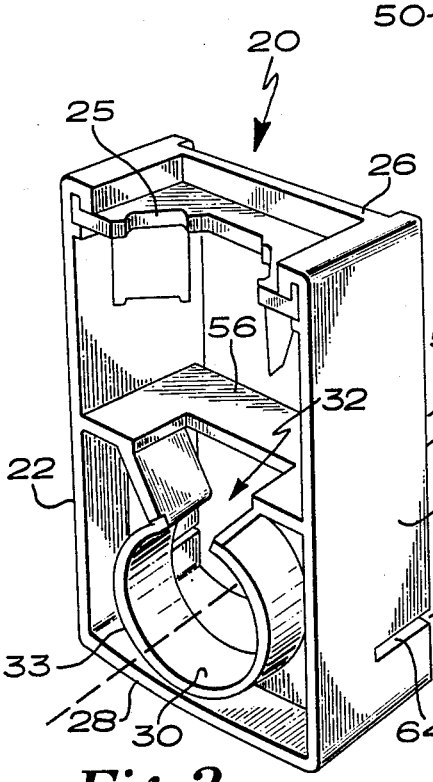
FIG. 2 is an exploded perspective view of the slide block of the invention showing the interrelationship of its basic parts during assembly.

As shown in FIG. 2, slide block 20, which slides vertically in jamb channels such as jamb channel 15, is of a generally rectangular shape having oppositely disposed sliding side surfaces 22 and 24, and upper head portion 26 and a lower enclosing bottom portion 28. Head portion 24 preferably includes a metal head plate 25 to which a spring balance mechanism (not shown) is connected. The metal head plate 25 serves as a stiffener for slider block 20 and prevents distortion of its shape from the forces exerted by the balance mechanism.

Slide block 20 is preferably made of a molded plastic material and is machined or otherwise smoothly finished on its sliding surfaces. Celcon® or Delrin® acetal plastic is preferred. Celcon® is a registered trademark of Celanese Chemical Co., New York, N.Y. Delrin® is a registered trademark of Hercules, Inc., Wilmington, Del.

Figure 6:
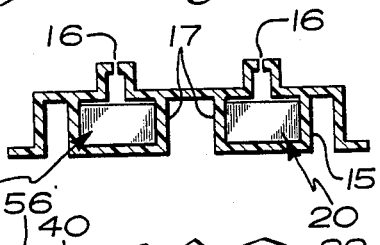
FIG. 6 is a cross-sectional view along line 6—6 of FIG. 4.
Figure 6:
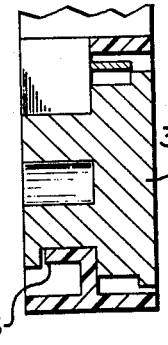

Slide block 20 also has a partial transverse base 30 with an open top, indicated at 32 for receiving rotatable locking cam 34 having a tab 36 which passes through opening 32 and when cam 34 is rotated in base 30 rises on its arcuate surface 33 to hold cam 34 in block 20 (best seen in FIG. 6).

Locking cam 34 also includes oppositely disposed arcuate camming surfaces 40 and 42 separated by straight, relieved surfaces 44 and 46 and a relatively large flat head portion 50.

Figure 5:
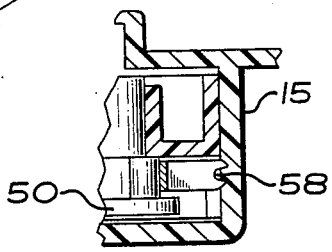
FIG. 5 is a cross-sectional view along line 5—5 of FIG. 3.

Head portion 50 acts to hold spring member 52 in position in the box-like enclosure 54 formed on the backside of slide block 20 (as shown with reference to FIG. 2). Enclosure 54 is formed by side members 22 and 24, bottom 28 and intermediate cross member 56. When locking cam 34 is inserted into base 30 with spring member 52 therebetween, the flat top of head 50 is flush with the edges of the members forming enclosure 54 to facilitate the fitting of slide block 20 into the jamb channel (best seen in FIG. 5).

Figure 4:
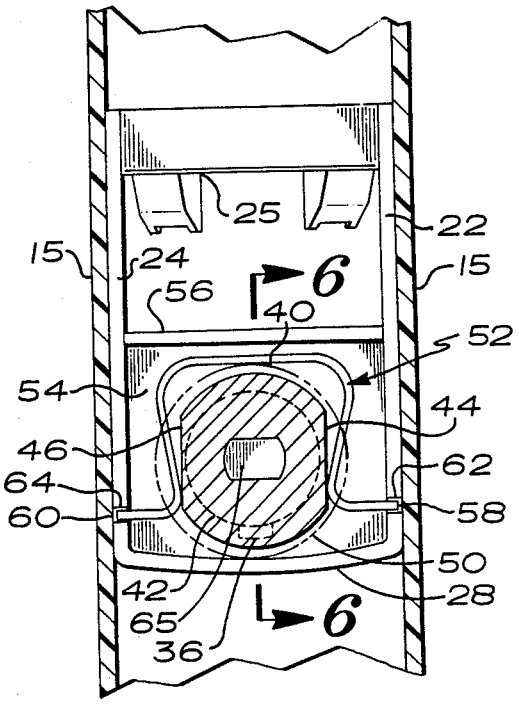
FIG. 4 is a cross-sectional view similar to FIG. 3 with the rotatable locking cam in a normal "unlocked" or sliding position.
Figure 3:
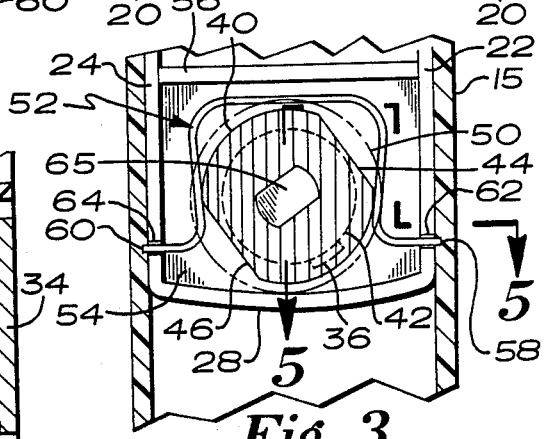
FIG. 3 is a partial cross-sectional view along lines 3—3 of FIG. 1 through the window frame and the front jamb channel to show the back side of the slide block (with reference to FIG. 2) and its position in the jamb track, with the head portion of the rotating locking cam removed for clarity and in a rotated "locked" position in the jamb channel.

Spring member 52 as shown includes oppositely serated end portions 58 and 69 which fit into slots 62 and 64, respectively to allow the extension (FIG. 3) and the retraction (FIG. 4) of serated ends 58 and 60 as the locking cam is rotated from the position shown in FIG. 4 to the position shown in FIG. 3.

The operation of the locking slide block will be clearly understood by reference to the drawings in which it has been previously noted that the slide block 20 is normally freely slidable in its jamb channel when the window sash to which it is operatively connected is in its normal vertical position. Upon the disengaging of sliding guide lock 13, the window sash is permitted to be tilted out to the pivoted position shown in FIG. 1. The movement of the sash is transmitted through a connecting pin (not shown) extending from the window sash into the conforming opening 63 in cam member 34 its connection to the rotary cam member 34 causing it to extend locking members 58 and 60 to be forced into the walls of jamb channel 15 thus holding the slide block in a locked position.

While the invention has been described with reference to certain features, structure and material, various modifications may be made without departing from the principle and scope of this invention as defined in the following claims.

What is claimed is:

1. A locking slide block for window jamb channels, comprising:

a body defining oppositely disposed sliding surfaces for guiding the block in a jamb channel, each of the sliding surfaces including an opening therein;

a pair of spaced locking members adapted for selectively engaging the jamb channel and locking the block in a fixed position, the members comprising the opposite outwardly directed ends of a generally U-shaped spring member, the ends of the spring member being serrated for penetrating the jamb channel, the spring member being received within the slide body and a serrated end portion of each member extending through one of the openings, respectively, the ends thereof being normally positioned within the openings on the sliding surfaces in a withdrawn position relative to the jamb channel so as not to interfere with the sliding movement of the block therein;

a rotary cam member and a transverse base in the body, the cam member being rotatably housed in the base in the space between the locking members, the cam member having oppositely disposed camming surfaces normally positioned in upper and lower position respectively on the cam whereby rotation of the cam member brings each one of the camming surfaces into contact with one of the locking members to urge them outwardly with respect to the associated sliding surfaces of the body for engagement with the jamb channel, the cam member including an enlarged head portion for holding the spring member within the body and a retaining tab at its end opposite the head portion engaging an end surface of the transverse base for retaining the slide block in assembled condition, and means included with the cam member for facilitating operative connection between it and a tilt-out window sash for rotating the cam when tilting the window.

2. The block of claim 1 wherein the U-shaped spring member is carried in the body in an inverted position.

3. The block of claim 1 wherein the head portion of the cam member is adapted for operative connection to a window sash.

4. The block as in claim 1 wherein the base includes an open section for assembly purposes.

5. The block as in claim 4 wherein the spring member is flat stock and the openings in the sliding surfaces are slots.

* * * * *

UNITED STATES PATENT AND TRADEMARK OFFICE

CERTIFICATE OF CORRECTION

PATENT NO. : 4,610,108

DATED : September 9, 1986

INVENTOR(S) : Gary J. Marshik

It is certified that error appears in the above-identified patent and that said Letters Patent are hereby corrected as shown below:

Column 3, line 25, the word appearing as "rises" should read --rides--.

Column 3, line 43, the numeral appearing as "69" should read --60--.

Column 4, line 33, the word appearing as "position" should read --positions--.

Signed and Sealed this

Thirtieth Day of December, 1986

*Attest:*

DONALD J. QUIGG

*Attesting Officer*

*Commissioner of Patents and Trademarks*